US011920876B2

(12) United States Patent
Zhang et al.

(10) Patent No.: US 11,920,876 B2
(45) Date of Patent: Mar. 5, 2024

(54) DISTRIBUTOR FOR PLATE HEAT EXCHANGER AND PLATE HEAT EXCHANGER

(71) Applicant: Danfoss Micro Channel Heat Exchanger (Jiaxing) Co., Ltd., Zhejiang (CN)

(72) Inventors: Zhifeng Zhang, Nordborg (DK); Zhixuan An, Haiyan (CN); Lingjie Zhang, Haiyan (CN)

(73) Assignee: DANFOSS MICRO CHANNEL HEAT EXCHANGER (JIAXING) CO., LTD., Zhejiang (CN)

( * ) Notice: Subject to any disclaimer, the term of this patent is extended or adjusted under 35 U.S.C. 154(b) by 0 days.

(21) Appl. No.: 17/542,598

(22) Filed: Dec. 6, 2021

(65) Prior Publication Data

US 2022/0187031 A1 Jun. 16, 2022

(30) Foreign Application Priority Data

Dec. 10, 2020 (CN) ..... 202011462217.6
Dec. 10, 2020 (CN) ..... 202022939568.3

(51) Int. Cl.
*F28F 3/08* (2006.01)
*F28F 3/10* (2006.01)

(52) U.S. Cl.
CPC ..... *F28F 3/086* (2013.01); *F28F 3/083* (2013.01); *F28F 3/10* (2013.01)

(58) Field of Classification Search
CPC ..... F28D 1/0325; F28D 9/005; F28F 9/026
See application file for complete search history.

(56) References Cited

U.S. PATENT DOCUMENTS 5,924,484 A * 7/1999 Andersson ..... F28D 9/005 165/178
2007/0089872 A1* 4/2007 Hou ..... F28F 9/026 165/167

(Continued)

FOREIGN PATENT DOCUMENTS

CN 106556263 A * 4/2017
CN 108195212 A * 6/2018

(Continued)

OTHER PUBLICATIONS

Translation of Chinese Patent Document CN109387111 entitled Translation—CN109387111 (Year: 2017).*

(Continued)

*Primary Examiner* — Paul Alvare
(74) *Attorney, Agent, or Firm* — McCormick, Paulding & Huber PLLC

(57) ABSTRACT

A distributor for a plate heat exchanger includes a tube part having a tube wall and having a first end and a second end; a first flange formed at the first end; and a connecting protrusion. The connecting protrusion projects from the tube wall of the tube part in a direction away from an axis of the tube part, and projects from the first flange at the inside of the outer edge of the first flange in a direction towards the second end of the tube part; the connecting protrusion has a connecting protrusion wall, which has an axial connecting protrusion wall that faces in the axial direction of the tube part and is remote from the first flange, the axial connecting protrusion wall being between the first end and the second end of the tube part, and having at least one through-hole.

19 Claims, 7 Drawing Sheets

(56) References Cited

U.S. PATENT DOCUMENTS

| | | | | |
|---|---|---|---|---|
| 2007/0261833 | A1* | 11/2007 | Yang | F28F 3/046 165/178 |
| 2007/0261834 | A1* | 11/2007 | Yang | F28F 3/046 165/178 |
| 2008/0196874 | A1* | 8/2008 | Bertilsson | F28D 9/005 165/167 |
| 2008/0283231 | A1* | 11/2008 | Horte | F28D 9/005 165/167 |
| 2015/0292803 | A1* | 10/2015 | Nyander | B23P 15/26 29/890.03 |
| 2016/0356560 | A1* | 12/2016 | Wei | F28F 3/10 |
| 2017/0016680 | A1* | 1/2017 | Zhang | F28F 3/042 |
| 2019/0145711 | A1* | 5/2019 | Mohammadian | F28F 9/026 165/134.1 |
| 2019/0331436 | A1* | 10/2019 | Dolderer | F28F 3/12 |
| 2022/0146204 | A1* | 5/2022 | Calaciura | F28F 9/026 |

FOREIGN PATENT DOCUMENTS

| | | | |
|---|---|---|---|
| CN | 109387111 | A * | 2/2019 |
| CN | 211575949 | U * | 9/2020 |
| CN | 113154910 | A * | 7/2021 |
| EP | 3 104 110 | A1 | 12/2016 |
| JP | 2013178078 | A * | 9/2013 |
| WO | 2005/121685 | A1 | 12/2005 |
| WO | 2019/161657 | A1 | 8/2019 |

OTHER PUBLICATIONS

Translation of Chinese Patent Document CN211575949U entitled Translation—CN211575949U (Year: 2020).*

Translation of Chinese Patent Document CN106556263A entitled Translation—CN106556263A (Year: 2015).*

Translation of JP2013178078A entitled Translation—JP2013178078A (Year: 2023).*

Extended European Search Report for European Patent Application No. 21213035.5 dated Mar. 31, 2022.

* cited by examiner

DISTRIBUTOR FOR PLATE HEAT EXCHANGER AND PLATE HEAT EXCHANGER

CROSS-REFERENCE TO RELATED APPLICATION

This application claims foreign priority benefits under 35 U.S.C. § 119 to Chinese Patent Application No. 202011462217.6 filed on Dec. 10, 2020, and to Chinese Patent Application No. 202022939568.3 filed on Dec. 10, 2020, the content of each is hereby incorporated by reference in its entirety.

TECHNICAL FIELD

The embodiments of the present invention relate to a distributor for a plate heat exchanger, and a plate heat exchanger.

BACKGROUND

In a plate heat exchanger, a heat exchange space is formed between two adjacent heat transfer plates. Fluid flows into the heat exchange space of the heat exchanger through a connecting pipe, a channel formed in the heat transfer plates, and a distributor. The function of the distributor is to control the distribution of fluid via one or more through-holes.

SUMMARY

An object of the embodiments of the present invention is to provide a distributor for a plate heat exchanger, and a plate heat exchanger, and thereby reduce the difficulty of manufacture of distributors and plate heat exchangers.

According to an embodiment of the present invention, a distributor for a plate heat exchanger is provided, comprising: a tube part, having a tube wall and having a first end and a second end, with a tube part inner cavity being defined in the tube part; a first flange formed at the first end, the first flange extending from the first end in a direction away from an axis of the tube part, the first flange having an outer edge remote from the tube part; and a connecting protrusion, projecting from the tube wall of the tube part in a direction away from the axis of the tube part, and projecting from the first flange at the inside of the outer edge of the first flange in a direction towards the second end of the tube part; the connecting protrusion having a connecting protrusion wall, with a connecting protrusion inner cavity being defined in the connecting protrusion wall, the connecting protrusion inner cavity being in communication with the tube part inner cavity; the connecting protrusion wall having an axial connecting protrusion wall which faces in the axial direction of the tube part and is remote from the first flange, the axial connecting protrusion wall being between the first end and the second end of the tube part, and having at least one through-hole.

According to an embodiment of the present invention, the axial connecting protrusion wall is at ⅓ to ⅔ of a distance between the first end and second end of the tube part.

According to an embodiment of the present invention, a distance between an outer edge of the axial connecting protrusion wall and an edge of the through-hole is 1-10 mm.

According to an embodiment of the present invention, a width of the first flange is 1-10 mm.

According to an embodiment of the present invention, the distributor for a plate heat exchanger further comprises: a positioning structure, configured to position the distributor relative to a heat transfer plate of the plate heat exchanger.

According to an embodiment of the present invention, the positioning structure is a positioning protrusion, which projects from the first flange at the inside of the outer edge of the first flange in a direction towards the second end of the tube part.

According to an embodiment of the present invention, the positioning protrusion projects from the tube wall of the tube part in a direction away from the axis of the tube part, and projects from the first flange at the inside of the outer edge of the first flange in a direction towards the second end of the tube part; the positioning protrusion has a positioning protrusion wall, with a positioning protrusion inner cavity being defined in the positioning protrusion wall, the positioning protrusion inner cavity being in communication with the tube part inner cavity.

According to an embodiment of the present invention, the positioning structure is a positioning piece projecting from an inner edge of the second flange.

According to an embodiment of the present invention, the positioning structure is a positioning piece projecting from the outer edge of the first flange.

According to an embodiment of the present invention, the distributor for a plate heat exchanger further comprises: a second flange formed at the second end of the tube part, the second flange extending from the second end of the tube part in a direction towards the axis of the tube part.

According to an embodiment of the present invention, the first flange and second flange are perpendicular to the axis of the tube part.

According to an embodiment of the present invention, the distributor is formed from a plate by stamping.

According to an embodiment of the present invention, the tube part is a truncated-cone-shaped tube part, with a diameter of the first end being greater than a diameter of the second end; the first flange extends radially outward from the first end; and the second flange extends radially inward from the second end.

According to an embodiment of the present invention, a plate heat exchanger is provided, comprising: a plurality of heat transfer plates; a heat exchange space formed between adjacent heat transfer plates amongst the plurality of heat transfer plates; a channel formed in the heat transfer plates, the channel allowing a heat exchange medium to flow into or out of the heat exchanger, wherein openings of the plurality of heat transfer plates form the channel; and the distributor described above, arranged at at least one said channel.

According to an embodiment of the present invention, the distributor further comprises: a positioning structure, configured to position the distributor relative to the heat transfer plate of the plate heat exchanger.

According to an embodiment of the present invention, the positioning structure is a positioning protrusion, which projects from the first flange at the inside of the outer edge of the first flange in a direction towards the second end of the tube part, and the heat transfer plate comprises a positioning protrusion, which is engaged in the positioning protrusion of the distributor.

According to an embodiment of the present invention, the positioning structure is a positioning piece projecting from an inner edge of the second flange, and the heat transfer plate comprises a positioning notch, which extends from an edge of the opening in a direction away from the opening, and the positioning piece of the distributor is bent and thereby engaged in the positioning notch of the heat transfer plate.

According to an embodiment of the present invention, the positioning structure is a positioning piece projecting from the outer edge of the first flange, and the heat transfer plate comprises a positioning through-hole which runs through the heat transfer plate, and the positioning piece of the distributor is bent and thereby engaged in the positioning through-hole of the heat transfer plate.

According to an embodiment of the present invention, the distributor is pre-fixed to the heat transfer plate by welding or bonding, such that the distributor is positioned relative to the heat transfer plate.

The distributor and plate heat exchanger according to embodiments of the present invention may reduce the difficulty of manufacture of distributors and plate heat exchangers.

DETAILED DESCRIPTION

Figure 1:
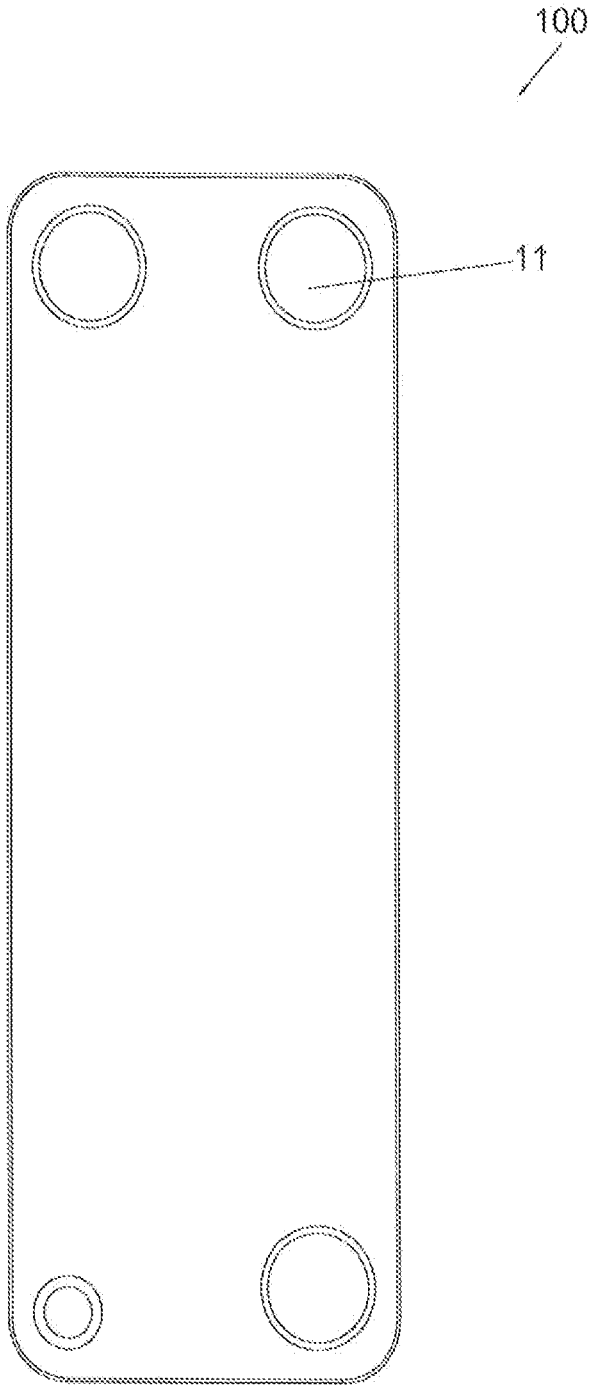
FIG. 1 is a schematic top view of a plate heat exchanger according to an embodiment of the present invention.
Figure 2:
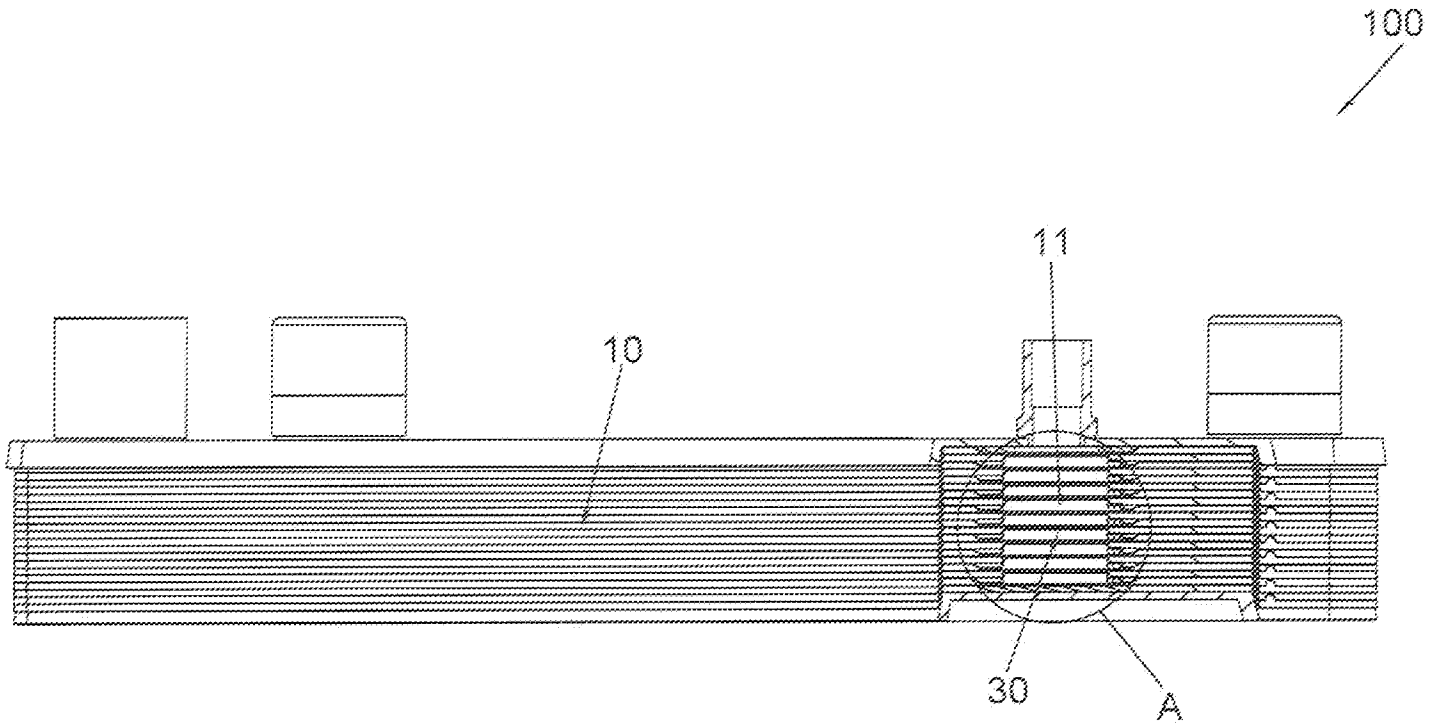
FIG. 2 is a schematic view of the plate heat exchanger shown in FIG. 1, looking obliquely towards the top from the bottom left corner, wherein a port at the lower left corner has been cut open.

The present invention is explained further below in conjunction with the drawings and particular embodiments.

As shown in FIGS. 1-7, a plate heat exchanger 100 according to an embodiment of the present invention comprises a plurality of heat transfer plates 10; a heat exchange space formed between adjacent heat transfer plates 10 amongst the plurality of heat transfer plates 10; a channel 11 formed in the heat transfer plates 10, the channel 11 allowing a heat exchange medium (e.g. a refrigerant) to flow into or out of the heat exchanger 100, wherein openings 13 of the plurality of heat transfer plates 10 form the channel 11; and a distributor 30 arranged at at least one said channel 11. The heat exchanger 100 may be a single-circuit heat exchanger such as that shown in FIG. 1, or a dual-circuit heat exchanger such as that shown in FIG. 5.

Figure 4:
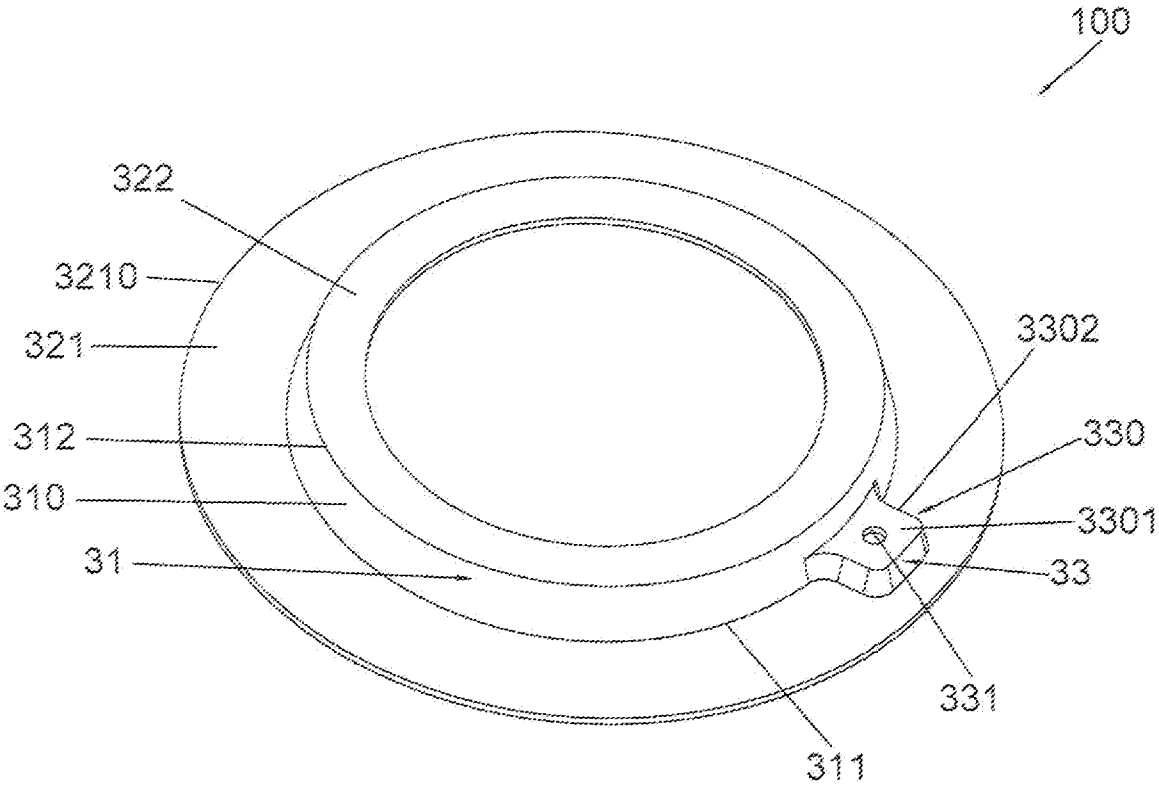
FIG. 4 is a schematic perspective view of a distributor for a plate heat exchanger according to an embodiment of the present invention.
Figure 6:
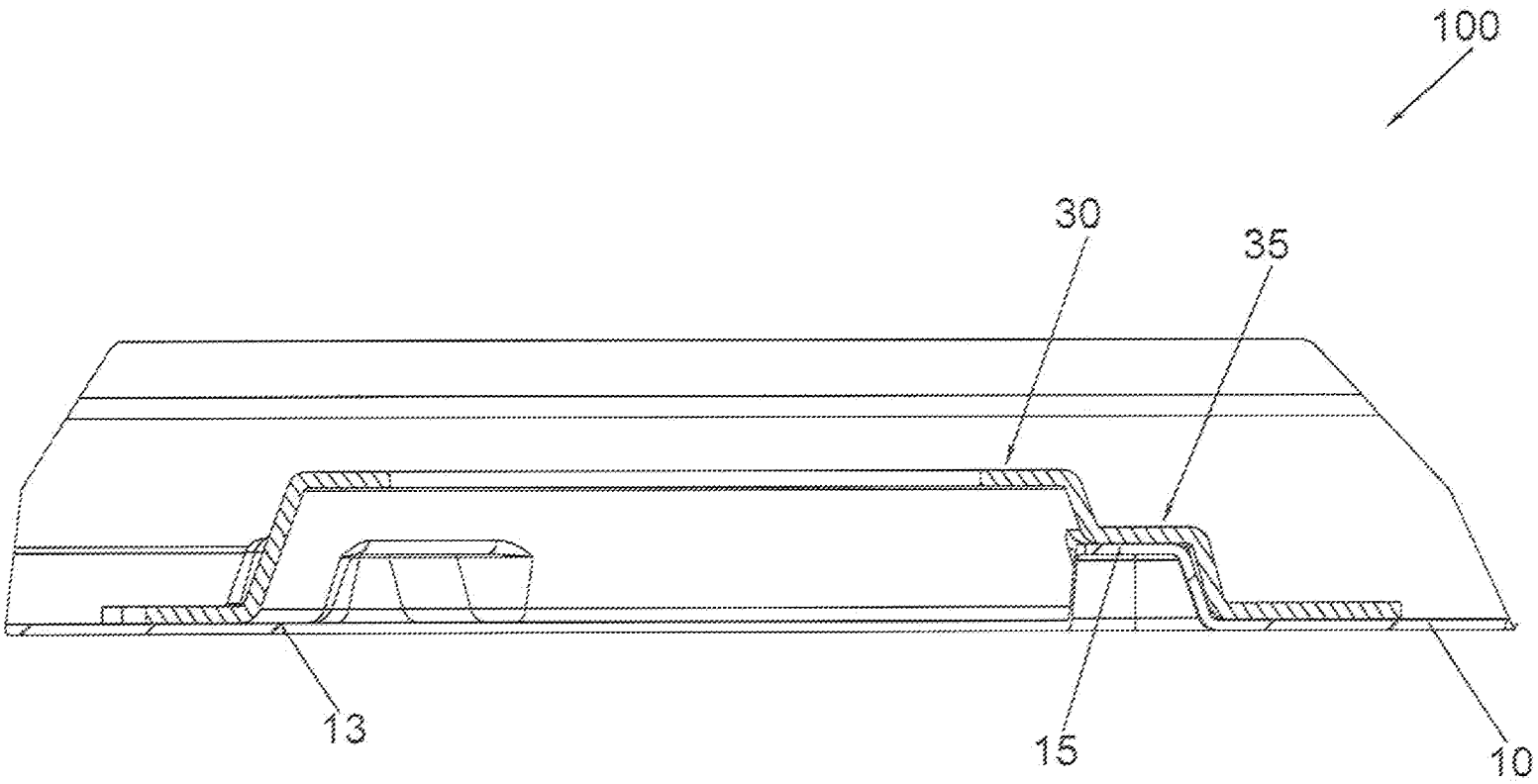
FIG. 6 is a schematic partial enlarged sectional view of a plate heat exchanger according to an embodiment of the present invention.

As shown in FIGS. 4 and 6, the distributor 30 for a plate heat exchanger according to an embodiment of the present invention comprises: a tube part 31, the tube part 31 having a tube wall 310 and having a first end 311 and a second end 312, with a tube part inner cavity being defined in the tube part 31; a first flange 321 formed at the first end 311, the first flange 321 extending from the first end 311 in a direction away from an axis of the tube part 31, the first flange 321 having an outer edge 3210 remote from the tube part 31; and a connecting protrusion 33, the connecting protrusion 33 projecting from the tube wall 310 of the tube part 31 in a direction away from the axis of the tube part 31, and projecting from the first flange 321 at the inside of the outer edge 3210 of the first flange 321 in a direction towards the second end 312 of the tube part 31; the connecting protrusion 33 has a connecting protrusion wall 330, with a connecting protrusion inner cavity being defined in the connecting protrusion wall 330, the connecting protrusion inner cavity being in communication with the tube part inner cavity; the connecting protrusion wall 330 has an axial connecting protrusion wall 3301 which faces in the axial direction of the tube part 31 and is remote from the first flange 321, the axial connecting protrusion wall 3301 being between the first end 311 and the second end 312 of the tube part 31, and having at least one through-hole 331. The number of through-hole(s) 331 may be one, two or more, and the shape of the through-hole 331 may be round or any other suitable shape. The number of connecting protrusion(s) 33 may be one, two or more, and the connecting protrusion 33 may have any suitable shape, e.g. substantially round or rectangular.

As shown in FIGS. 4 and 6, in an embodiment of the present invention, the distributor 30 further comprises: a second flange 322 formed at the second end 312 of the tube part 31, the second flange 322 extending from the second end 312 of the tube part 31 in a direction towards the axis of the tube part 31. The first flange 321 and second flange 322 may be perpendicular to the axis of the tube part 31. The distributor 30 may be formed from a plate by stamping. According to an example of the present invention, the tube part 31 may be a truncated-cone-shaped tube part 31, with the diameter of the first end 311 being greater than the diameter of the second end 312; the first flange 321 extends radially outward from the first end 311; and the second flange 322 extends radially inward from the second end 312. The first flange 321 and second flange 322 have an annular shape, and have openings therein.

Figure 3:
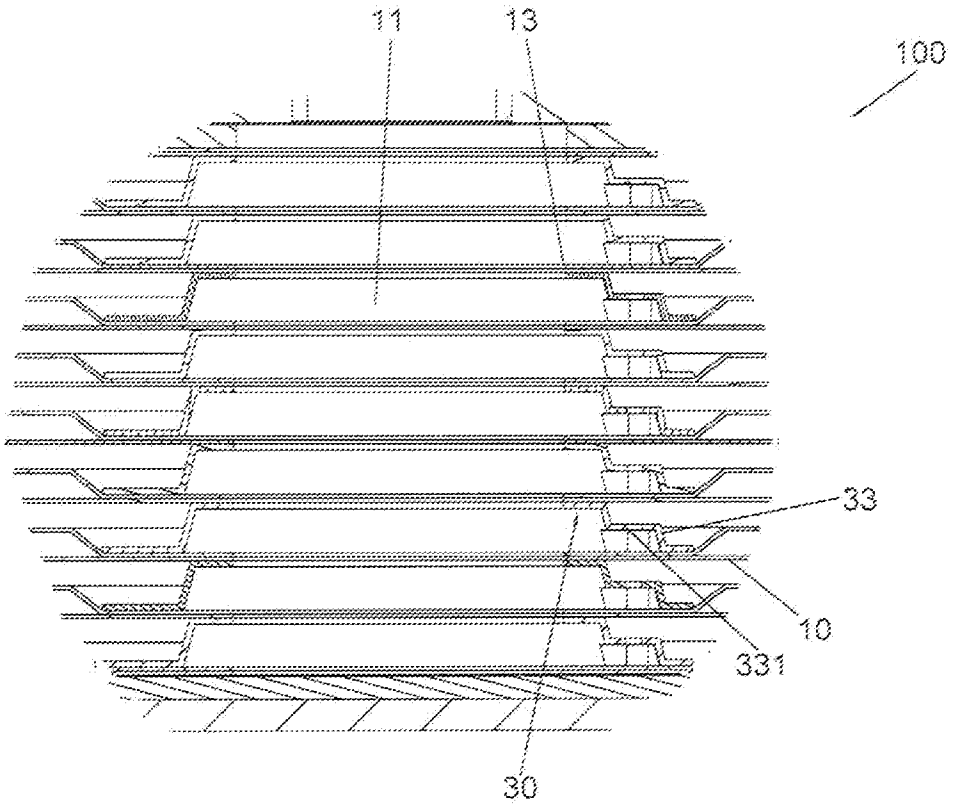
FIG. 3 is a schematic enlarged sectional view of part A of the plate heat exchanger shown in FIG. 1.

As shown in FIG. 3, the distributor 30 is arranged at the channel 11, between adjacent heat transfer plates 10, and is configured to connect the channel 11 to the heat exchange space between the adjacent heat transfer plates 10. The first flange 321 is connected to one of the adjacent heat transfer plates 10, and the second flange 322 is connected to the other of the adjacent heat transfer plates 10. The distributor 30 is generally provided at the channel that acts as a refrigerant inlet.

Figure 7:
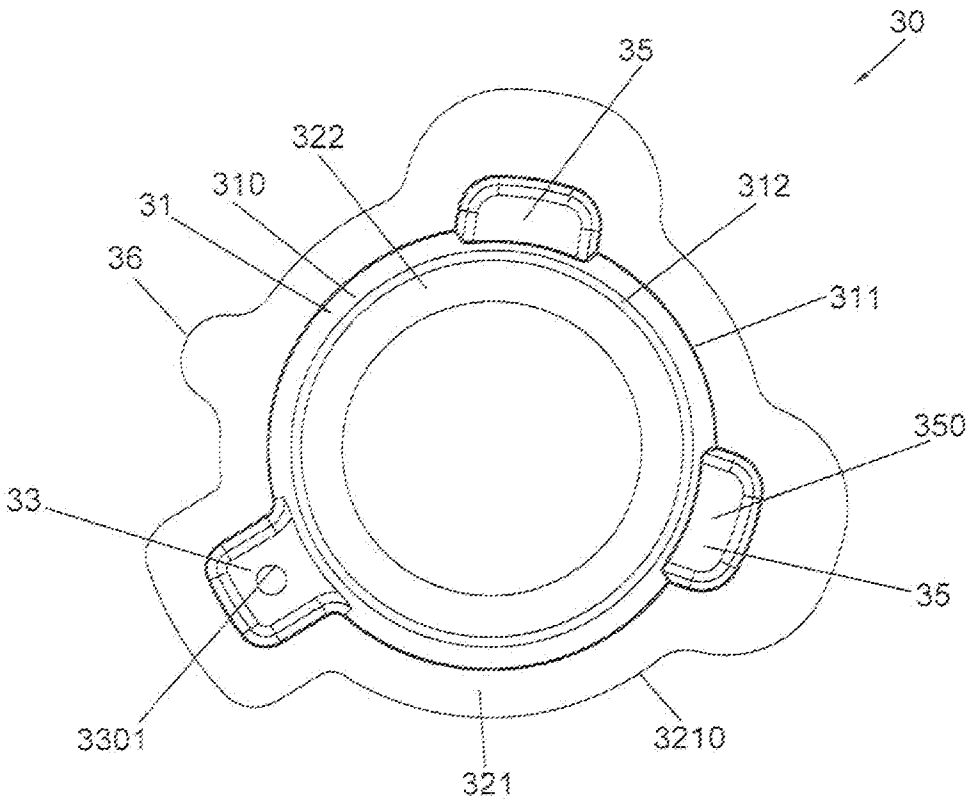
FIG. 7 is a schematic top view of a distributor for a plate heat exchanger according to an embodiment of the present invention.

As shown in FIGS. 4, 6 and 7, in an embodiment of the present invention, the axial connecting protrusion wall 3301 may be at ⅓ to ⅔ of a distance between the first end 311 and second end 312 of the tube part 31, e.g. may be substantially at the midpoint between the first end 311 and second end 312. A distance between an outer edge of the axial connecting protrusion wall 3301 and an edge of the through-hole 331 may be 1-10 mm. A width of the first flange 321 (i.e. the width thereof in a radial direction) is 1-10 mm.

Figure 5:
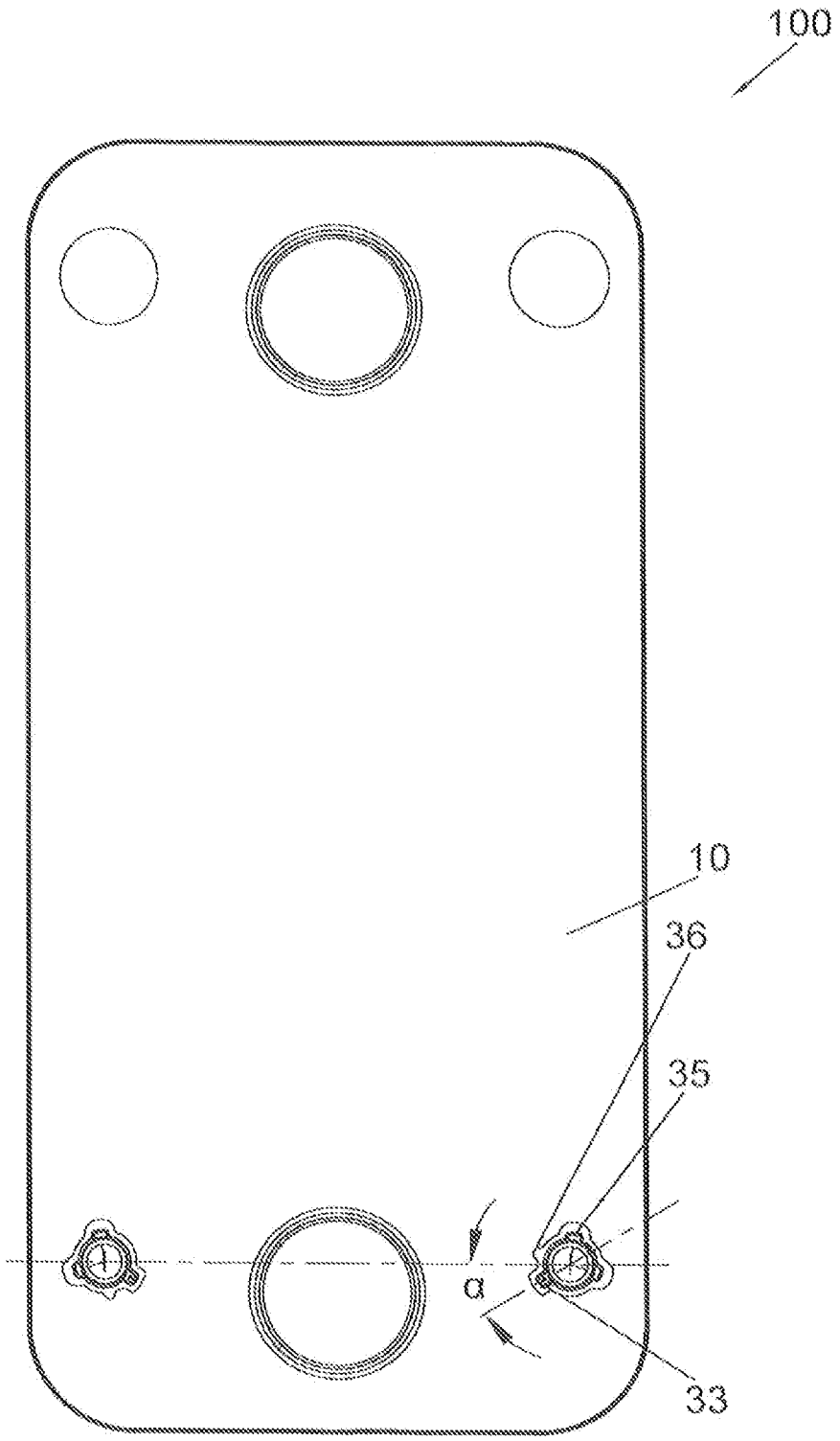
FIG. 5 is a schematic top view of a plate heat exchanger according to an embodiment of the present invention.

Referring to FIGS. 5-7, in an embodiment of the present invention, the distributor 30 further comprises a positioning structure, configured to position the distributor 30 relative to the heat transfer plate 10 of the plate heat exchanger 100. The positioning structure may be a positioning protrusion 35, which projects from the first flange 321 at the inside of the outer edge 3210 of the first flange 321 in a direction towards the second end 312 of the tube part 31. According to an example of the present invention, the positioning protrusion 35 projects from the tube wall 310 of the tube part 31 in a direction away from the axis of the tube part 31, and projects from the first flange 321 at the inside of the outer edge 3210 of the first flange 321 in a direction towards the second end 312 of the tube part 31; the positioning protrusion 35 has a positioning protrusion wall 350, with a positioning protrusion inner cavity being defined in the positioning protrusion wall 350, the positioning protrusion inner cavity being in communication with the tube part inner cavity. According to an example of the present invention, the heat transfer plate 10 of the heat exchanger 100 has a positioning protrusion 15; the positioning protrusion 15 of the heat transfer plate 10 may be a protrusion pressed out of the heat transfer plate 10, or a part that is turned up after cutting open a part of the heat transfer plate 10. Referring to FIG. 6, the positioning protrusion 15 of the heat transfer plate 10 extends (e.g. extends radially) from an edge of the opening 13 in a direction away from the opening, and extends from the heat transfer plate 10 towards one side of the heat transfer plate 10 (one side in the direction in which the heat exchange plates 10 are stacked). The positioning protrusion 15 of the heat transfer plate 10 is engaged in the positioning protrusion 35 of the distributor 30, in order to position the distributor 30 relative to the heat transfer plate 10. The number of positioning protrusion(s) 35 may be one, two or more. In this way, an angle $\alpha$ between a line connecting the through-hole 331 to a centre line of the distributor 30, and a horizontal plane passing through the centre line of the distributor 30, is fixed. When the heat exchanger is placed according to requirements of use, the through-hole 331 is below this horizontal plane. That is to say, the angle $\alpha$ is 0°-180°; in a preferred solution, a is 30°-90°. There are no restrictions on the specific form and quantity of the positioning structure(s); positioning by shape or positioning by engagement slot are possible. For example, two positioning protrusions may be formed on a bottom surface of the distributor, or a part of the heat transfer plate may be cut open and then turned up, and at the same time, two matching positioning protrusions may be formed at the same positions on the plate below the distributor. According to an example of the present invention, the positioning structure is a positioning piece projecting from an inner edge of the second flange 322, and the heat transfer plate 10 comprises a positioning notch; the positioning notch of the heat transfer plate 10 extends from the edge of the opening 13 in a direction away from the opening 13, and the positioning piece of the distributor 30 is bent and thereby engaged in the positioning notch of the heat transfer plate 10, such that a part of the positioning piece is bent onto a surface of the heat transfer plate 10, thus locking the distributor 30. According to another example of the present invention, the positioning structure is a positioning piece projecting from the outer edge 3210 of the first flange 321, and the heat transfer plate 10 comprises a positioning through-hole; the positioning through-hole of the heat transfer plate 10 runs through the heat transfer plate 10, and the positioning piece of the distributor 30 is bent and thereby engaged in the positioning through-hole of the heat transfer plate 10, such that a part of the positioning piece is bent onto a surface of the heat transfer plate 10, thus locking the distributor 30. According to another example of the present invention, the distributor 30 is pre-fixed to the heat transfer plate 10 by welding or bonding, such that the distributor 30 is positioned relative to the heat transfer plate 10.

Referring to FIGS. 5 and 7, in an embodiment of the present invention, the distributor 30 further comprises: a protruding piece 36 projecting from the outer edge 3210 of the first flange 321 in a direction away from the axis of the tube part 31, or an indentation that is sunk from the outer edge 3210 of the first flange 321 in a direction towards the axis of the tube part 31, to enable an automated production line to identify front and back sides of the distributor 30.

According to an embodiment of the present invention, the height of the distributor 30 may be substantially equal to the distance between those parts of the heat transfer plates 10 that surround the channel 11.

According to an embodiment of the present invention, the distributor requires only two technical processes, namely stamping and punching, using a plate, thus the difficulty of manufacture may be reduced. The design of the connecting protrusion 33 and the through-hole 3301 not only ensures excellent distribution, but may also avoid the risk of the through-hole 3301 being blocked by solder, such as copper film, during brazing.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A distributor for a plate heat exchanger, comprising:

a tube part, having a tube wall and having a first end and a second end, with a tube part inner cavity being defined in the tube part;

a first flange formed at the first end, the first flange extending from the first end in a direction away from an axis of the tube part, the first flange having an outer edge remote from the tube part; and a connecting protrusion, projecting from the tube wall of the tube part in a direction away from the axis of the tube part, and projecting from the first flange at the inside of the outer edge of the first flange in a direction towards the second end of the tube part;

the connecting protrusion having a connecting protrusion wall, with a connecting protrusion inner cavity being defined in the connecting protrusion wall, the connecting protrusion inner cavity being in communication with the tube part inner cavity;

the connecting protrusion wall having an axial connecting protrusion wall which faces in the axial direction of the tube part and is remote from the first flange, the axial connecting protrusion wall being between the first end and the second end of the tube part, and having at least one through-hole; and wherein the connecting protrusion extends over an opening in the first flange.

2. The distributor for a plate heat exchanger according to claim 1, wherein:

the axial connecting protrusion wall is at ⅓ to ⅔ of a distance extending from the first end to the second end of the tube part.

3. The distributor for a plate heat exchanger according to claim 1, wherein:

a distance between an outer edge of the axial connecting protrusion wall and an edge of the through-hole is 1-10 mm.

4. The distributor for a plate heat exchanger according to claim 1, wherein:

a width of the first flange is 1-10 mm.

5. The distributor for a plate heat exchanger according to claim 1, further comprising:

a positioning structure, configured to position the distributor relative to a heat transfer plate of the plate heat exchanger.

6. The distributor for a plate heat exchanger according to claim 5, wherein:

the positioning structure is a positioning protrusion, which projects from the first flange at the inside of the outer edge of the first flange in a direction towards the second end of the tube part.

7. The distributor for a plate heat exchanger according to claim 5, wherein:

the positioning structure is a positioning piece projecting from the outer edge of the first flange.

8. The distributor for a plate heat exchanger according to claim 1, further comprising:

a second flange formed at the second end of the tube part, the second flange extending from the second end of the tube part in a direction towards the axis of the tube part.

9. The distributor for a plate heat exchanger according to claim 8, wherein:

the first flange and second flange are perpendicular to the axis of the tube part.

10. The distributor for a plate heat exchanger according to claim 1, wherein:

the distributor is formed from a plate by stamping.

11. The distributor for a plate heat exchanger according to claim 8, wherein:

the tube part is a truncated-cone-shaped tube part, with a diameter of the first end being greater than a diameter of the second end;

the first flange extends radially outward from the first end; and the second flange extends radially inward from the second end.

12. A plate heat exchanger, comprising:

a plurality of heat transfer plates;

a heat exchange space formed between adjacent heat transfer plates amongst the plurality of heat transfer plates;

a channel formed in the heat transfer plates, the channel allowing a heat exchange medium to flow into or out of the heat exchanger, wherein openings of the plurality of heat transfer plates form the channel; and the distributor according to claim 1, arranged at at least one said channel.

13. The plate heat exchanger according to claim 12, wherein:

the distributor is pre-fixed to the heat transfer plate by welding or bonding, such that the distributor is positioned relative to the heat transfer plate.

14. The plate heat exchanger according to claim 12, wherein:

the distributor further comprises: a positioning structure, configured to position the distributor relative to the heat transfer plate of the plate heat exchanger.

15. The plate heat exchanger according to claim 14, wherein:

the positioning structure is a positioning protrusion, which projects from the first flange at the inside of the outer edge of the first flange in a direction towards the second end of the tube part, and the heat transfer plate comprises a positioning protrusion, which is engaged in the positioning protrusion of the distributor.

16. A distributor for a plate heat exchanger, comprising:

a tube part, having a tube wall and having a first end and a second end, with a tube part inner cavity being defined in the tube part;

a first flange formed at the first end, the first flange extending from the first end in a direction away from an axis of the tube part, the first flange having an outer edge remote from the tube part; and a connecting protrusion, projecting from the tube wall of the tube part in a direction away from the axis of the tube part, and projecting from the first flange at the inside of the outer edge of the first flange in a direction towards the second end of the tube part;

the connecting protrusion having a connecting protrusion wall, with a connecting protrusion inner cavity being defined in the connecting protrusion wall, the connecting protrusion inner cavity being in communication with the tube part inner cavity;

the connecting protrusion wall having an axial connecting protrusion wall which faces in the axial direction of the tube part and is remote from the first flange, the axial connecting protrusion wall being between the first end and the second end of the tube part, and having at least one through-hole;

further comprising:

a positioning structure, configured to position the distributor relative to a heat transfer plate of the plate heat exchanger;

wherein the positioning structure is a positioning protrusion, which projects from the first flange at the inside of the outer edge of the first flange in a direction towards the second end of the tube part; and wherein:

the positioning protrusion projects from the tube wall of the tube part in a direction away from the axis of the tube part, and projects from the first flange at the inside of the outer edge of the first flange in a direction towards the second end of the tube part; the positioning protrusion has a positioning protrusion wall, with a positioning protrusion inner cavity being defined in the positioning protrusion wall, the positioning protrusion inner cavity being in communication with the tube part inner cavity.

17. A distributor for a plate heat exchanger, comprising:

a tube part, having a tube wall and having a first end and a second end, with a tube part inner cavity being defined in the tube part;

a first flange formed at the first end, the first flange extending from the first end in a direction away from an axis of the tube part, the first flange having an outer edge remote from the tube part; and a connecting protrusion, projecting from the tube wall of the tube part in a direction away from the axis of the tube part, and projecting from the first flange at the inside of the outer edge of the first flange in a direction towards the second end of the tube part;

the connecting protrusion having a connecting protrusion wall, with a connecting protrusion inner cavity being defined in the connecting protrusion wall, the connecting protrusion inner cavity being in communication with the tube part inner cavity;

the connecting protrusion wall having an axial connecting protrusion wall which faces in the axial direction of the tube part and is remote from the first flange, the axial connecting protrusion wall being between the first end and the second end of the tube part, and having at least one through-hole;

further comprising:

a positioning structure, configured to position the distributor relative to a heat transfer plate of the plate heat exchanger; and further comprising:

a second flange formed at the second end of the tube part, the second flange extending from the second end of the tube part in a direction towards the axis of the tube part, wherein:

the positioning structure is a positioning piece projecting from an inner edge of the second flange.

18. A plate heat exchanger, comprising:

a plurality of heat transfer plates;

a heat exchange space formed between adjacent heat transfer plates amongst the plurality of heat transfer plates;

a channel formed in the heat transfer plates, the channel allowing a heat exchange medium to flow into or out of the heat exchanger, wherein openings of the plurality of heat transfer plates form the channel; and a distributor for a plate heat exchanger, comprising:

a tube part, having a tube wall and having a first end and a second end, with a tube part inner cavity being defined in the tube part;

a first flange formed at the first end, the first flange extending from the first end in a direction away from an axis of the tube part, the first flange having an outer edge remote from the tube part; and a connecting protrusion, projecting from the tube wall of the tube part in a direction away from the axis of the tube part, and projecting from the first flange at the inside of the outer edge of the first flange in a direction towards the second end of the tube part;

the connecting protrusion having a connecting protrusion wall, with a connecting protrusion inner cavity being defined in the connecting protrusion wall, the connecting protrusion inner cavity being in communication with the tube part inner cavity;

the connecting protrusion wall having an axial connecting protrusion wall which faces in the axial direction of the tube part and is remote from the first flange, the axial connecting protrusion wall being between the first end and the second end of the tube part, and having at least one through-hole;

the distributor arranged at at least one said channel;

wherein the distributor further comprises: a positioning structure, configured to position the distributor relative to the heat transfer plate of the plate heat exchanger; and further comprising:

a second flange formed at the second end of the tube part, the second flange extending from the second end of the tube part in a direction towards the axis of the tube part, wherein:

the positioning structure is a positioning piece projecting from an inner edge of the second flange, and the heat transfer plate comprises a positioning notch, which extends from an edge of the opening in a direction away from the opening, and the positioning piece of the distributor is bent and thereby engaged in the positioning notch of the heat transfer plate.

19. A plate heat exchanger, comprising:

a plurality of heat transfer plates;

a heat exchange space formed between adjacent heat transfer plates amongst the plurality of heat transfer plates;

a channel formed in the heat transfer plates, the channel allowing a heat exchange medium to flow into or out of the heat exchanger, wherein openings of the plurality of heat transfer plates form the channel; and a distributor for a plate heat exchanger, comprising:

a tube part, having a tube wall and having a first end and a second end, with a tube part inner cavity being defined in the tube part;

a first flange formed at the first end, the first flange extending from the first end in a direction away from an axis of the tube part, the first flange having an outer edge remote from the tube part; and a connecting protrusion, projecting from the tube wall of the tube part in a direction away from the axis of the tube part, and projecting from the first flange at the inside of the outer edge of the first flange in a direction towards the second end of the tube part;

the connecting protrusion having a connecting protrusion wall, with a connecting protrusion inner cavity being defined in the connecting protrusion wall, the connecting protrusion inner cavity being in communication with the tube part inner cavity;

the connecting protrusion wall having an axial connecting protrusion wall which faces in the axial direction of the tube part and is remote from the first flange, the axial connecting protrusion wall being between the first end and the second end of the tube part, and having at least one through-hole;

the distributor arranged at at least one said channel;

wherein the distributor further comprises: a positioning structure, configured to position the distributor relative to the heat transfer plate of the plate heat exchanger; and wherein:

the positioning structure is a positioning piece projecting from the outer edge of the first flange, and the heat transfer plate comprises a positioning through-hole which runs through the heat transfer plate, and the positioning piece of the distributor is bent and thereby engaged in the positioning through-hole of the heat transfer plate.

* * * * *